US008172602B2

(12) United States Patent
Patel et al.

(10) Patent No.: US 8,172,602 B2
(45) Date of Patent: May 8, 2012

(54) PLUGGABLE CABLE CONNECTOR

(75) Inventors: Satish I. Patel, Roselle, IL (US); Surendra Chitti Babu, Tinley Park, IL (US); Mysore Purushotham Divakar, San Jose, CA (US); Paul B. DuCharme, New Lenox, IL (US); Masud Bolouri-Saransar, Orland Park, IL (US); Paul W. Wachtel, Arlington Heights, IL (US); David E. Urbasic, Chicago, IL (US); Nicholas G. Martino, Crete, IL (US); Ronald L. Tellas, Schereville, IN (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 13/283,692

(22) Filed: Oct. 28, 2011

(65) Prior Publication Data

US 2012/0045942 A1 Feb. 23, 2012

Related U.S. Application Data

(63) Continuation of application No. 12/487,778, filed on Jun. 19, 2009, now Pat. No. 8,047,865.

(60) Provisional application No. 61/074,440, filed on Jun. 20, 2008, provisional application No. 61/074,422, filed on Jun. 20, 2008.

(51) Int. Cl.
*H01R 12/24* (2006.01)

(52) U.S. Cl. ..... 439/499

(58) Field of Classification Search ..... 439/499, 439/466, 468, 473, 76.1, 694, 606, 902, 445, 439/453

See application file for complete search history.

(56) References Cited

U.S. PATENT DOCUMENTS

| | | | | |
|---|---|---|---|---|
| 3,714,385 | A | 1/1973 | Leverich | |
| 4,389,083 | A * | 6/1983 | Normann et al. | 439/453 |
| 5,674,095 | A * | 10/1997 | Tanhehco et al. | 439/731 |
| 6,161,282 | A * | 12/2000 | Nieslony | 29/860 |
| 6,773,296 | B2 * | 8/2004 | Kihira et al. | 439/445 |
| 7,204,648 | B2 | 4/2007 | Aronson | |
| 7,367,840 | B2 | 5/2008 | Chen et al. | |
| 7,445,458 | B1 | 11/2008 | Yamane | |
| 7,453,338 | B2 | 11/2008 | Aronson | |
| 7,762,841 | B2 | 7/2010 | Ho | |
| 7,806,726 | B2 | 10/2010 | Chen et al. | |
| 2007/0141871 | A1 | 6/2007 | Scherer et al. | |

* cited by examiner

*Primary Examiner* — Tulsidas C Patel
*Assistant Examiner* — Phuongchi Nguyen
(74) *Attorney, Agent, or Firm* — Robert A. McCann; Christopher S. Clancy; Christopher K. Marlow

(57) ABSTRACT

A pair manager for use in securing a twin-axial cable to a printed circuit board is described. The pair manager comprises a generally block-shaped portion containing a pair of channels. The channels extend from the front face to the rear face of the block-shaped portion. An integral flange and a pair of integral fingers extend perpendicularly from the front face of the block-shaped portion. The flange extends generally from the center of the front face and the fingers extend from opposite edges of the front face. The fingers and flange function as a partial shield cavity around each pair of conductors. This design helps to maintain better impedance matching when connecting twin-axial cables to a printed circuit board.

5 Claims, 16 Drawing Sheets

PLUGGABLE CABLE CONNECTOR

CROSS REFERENCE TO RELATED APPLICATIONS

This application is a continuation of U.S. patent application Ser. No. 12/487,778, filed Jun. 19, 2009, which claims priority to U.S. Provisional Patent Application No. 61/074,440, filed Jun. 20, 2008, and U.S. Provisional Patent Application No. 61/074,422, filed on Jun. 20, 2008, the subject matters of which are hereby incorporated by reference in their entireties.

FIELD OF THE INVENTION

The present invention relates generally to connectors, and more particularly, to an improved pluggable cable connector design.

BACKGROUND OF THE INVENTION

Network hardware vendors including Cisco, Extreme Networks, Arastra, and others offer families of 10 Gb/sec. switch products that unify Local Area Networks (LAN) and Storage Area Networks (SAN) using protocols for Unified Network Fabric Using Fiber Channel Over Ethernet (FCOE). Cisco, for example, has introduced the Nexus family of switches (Nexus 5000 and Nexus 7000) that seamlessly communicate with disparate communications protocols such as Fiber Channel (for SANs) and Ethernet/IP (LANs).

For relatively short digital links (<20 meters), twin-ax cable is a preferred transmission medium due to the significantly lower cost per link compared to optical fiber. Twin-ax cable conductors are typically terminated on SFP+ (small form-factor pluggable) connectors, and in particular, on paddle boards or PCBs (Printed Circuit Boards) in the SFP+ pluggable connectors. At the cable termination interface, the reflections of the high-speed signals (e.g. 10 Gb/sec) are at their maximum. The SFP+ cable assemblies are used to interconnect from a Nexus 5000 (or similar) switch typically located at the top of a rack to other switches in the same or adjacent racks. Typical lengths of such connectivities are one, three, and five meters with no compensation on the connector's PCB for receive equalization and transmit pre-emphasis. Longer reaches of 10 to 20 meters are feasible and may require a pre-emphasis driver ASIC located on the connector's PCB.

However, terminating high-speed twin-ax cables to the paddle card in SFP+ cable assemblies used in Fiber Channel Over Ethernet (FCOE) deployment has been difficult. At the junction where the twin-ax conductors are soldered (or welded) to the paddle card pads, the reflection of high-speed signals (10 Gb/s) tends to be highest due to the fact that the shields are either stripped or folded back to accommodate attachment to the PCB. Improving the method of attachment (soldering, resistive welding, conductive epoxying, etc.) provides only marginal improvements in impedance matching. Further, there is a need to keep the spacing between the two pairs of twin-ax cable constant for manufacturability improvements. Protecting the soldered or welded cable-to-paddle card interface by means of strain relief is also desirable in the SFP+ cable assemblies.

In addition, the mechanism for latching the pluggable connector to the switch port and de-latching the pluggable connector from the switch port needs to be robust and reliable.

Needed is a quick and reliable method for attaching the twin-ax media to the host system.

DETAILED DESCRIPTION OF THE PREFERRED EMBODIMENTS

Figure 1:
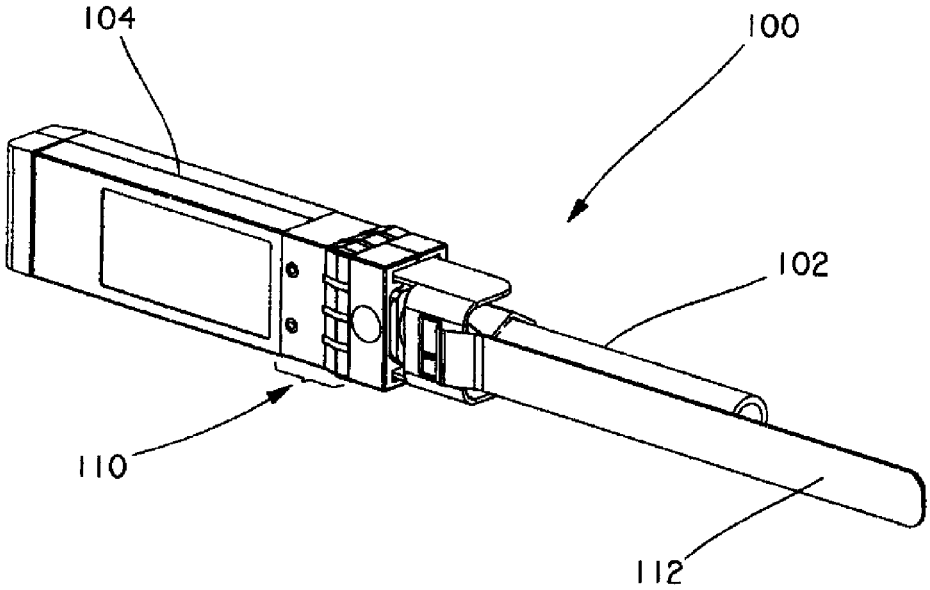
FIGS. 1 and 2 are perspective views of a pluggable cable connector.
Figure 2:
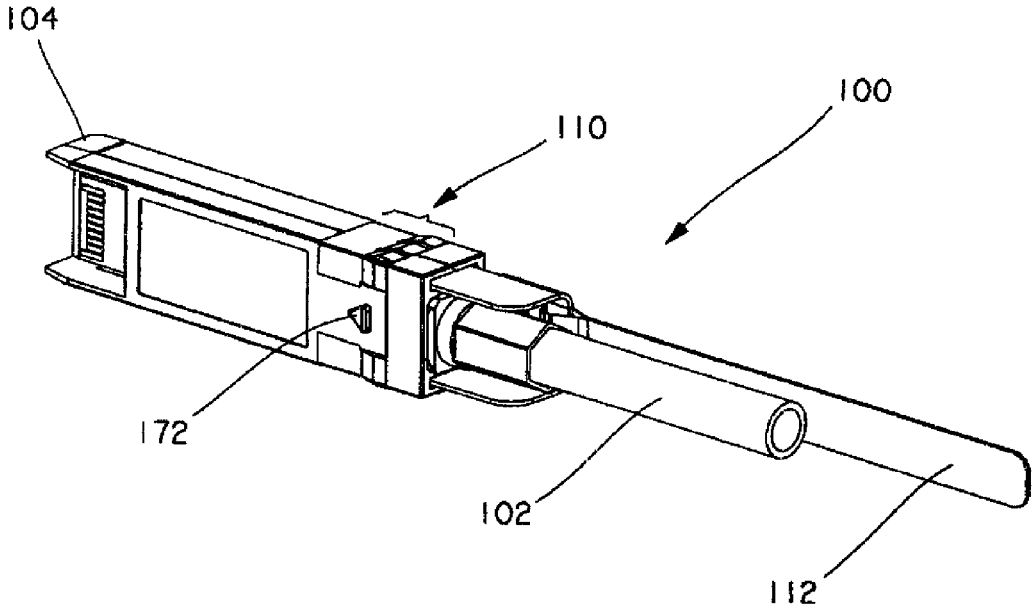
Figure 3:
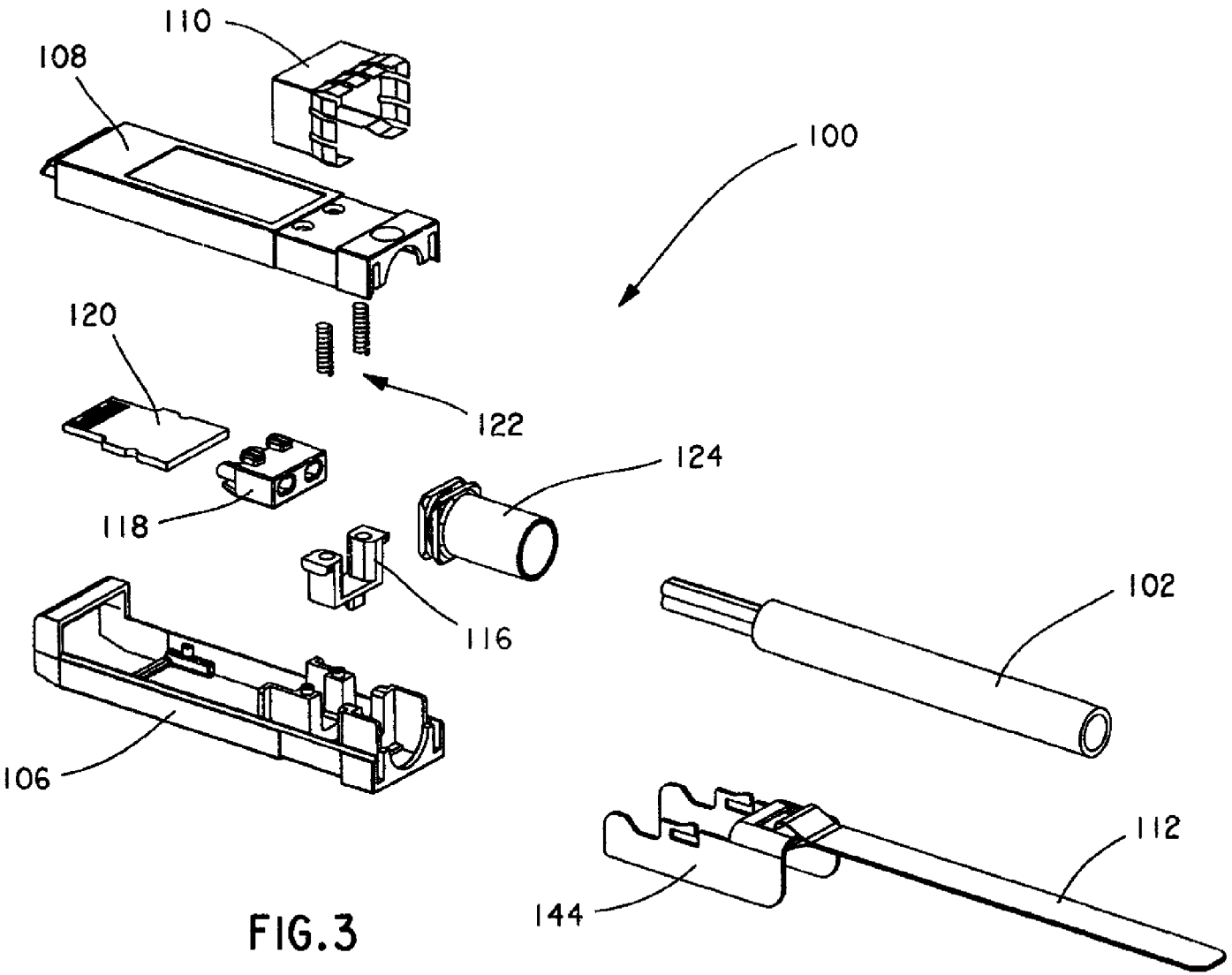
FIG. 3 is an exploded view of a pluggable cable connector.

FIGS. 1-3 are perspective view illustrations (assembled and exploded) of a pluggable cable connector 100, in accordance with an embodiment of the present invention. The connector 100 is preferably constructed to be part of a Small Form-factor Pluggable (SFP) cable assembly that complies with the physical requirements of SFF-8432 Specification for Improved Pluggable Form-Factor-Revision 5.0 dated Jul. 16, 2007. The connector 100 terminates a cable 102 and includes a shell 104 comprising a bottom shell 106 and a top shell 108 (See FIG. 3). The bottom shell 106 and top shell 108 are preferably zinc die-cast housings assembled together by front inter-locks and formed integral rivets.

An EMI gasket 110 may be included for protection against EMI (Electro-Magnetic Interference) effects. A pull tab 112 acts on a latch release 114 to cause a latch 116 (loaded by springs 122) to release the connector 100 from a host receptacle (not shown) by recessing a latch tooth 172 while a pulling force is applied to the pull tab 112. In an alternative embodiment, the pull tab 112 is integrally molded with the latch release 114.

Figure 22:
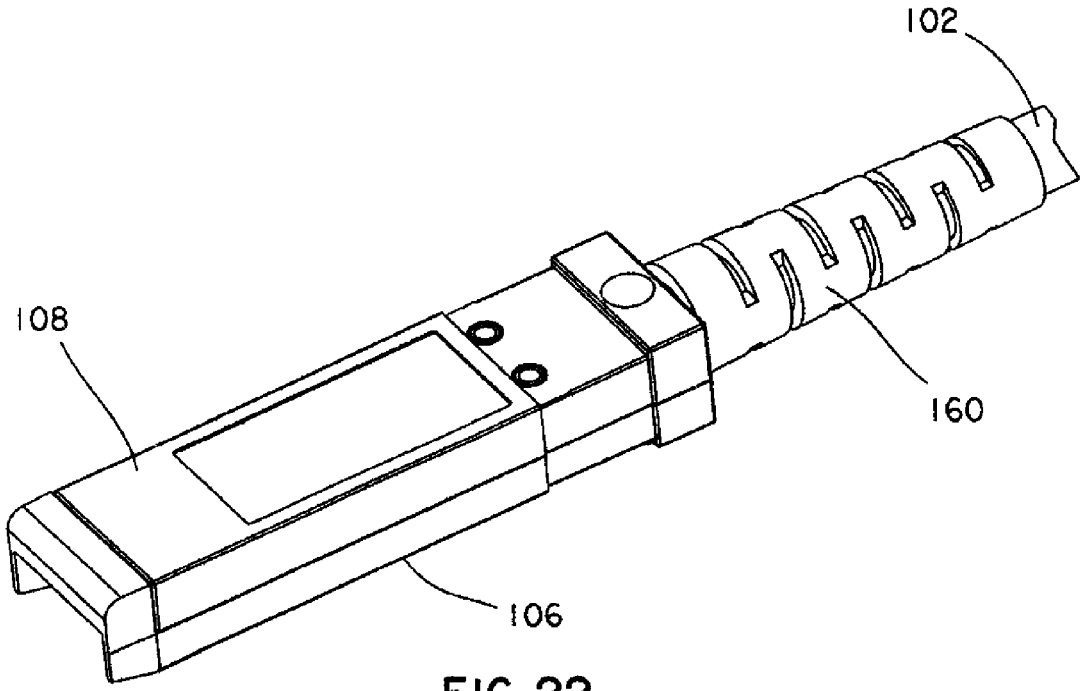
Figure 23:
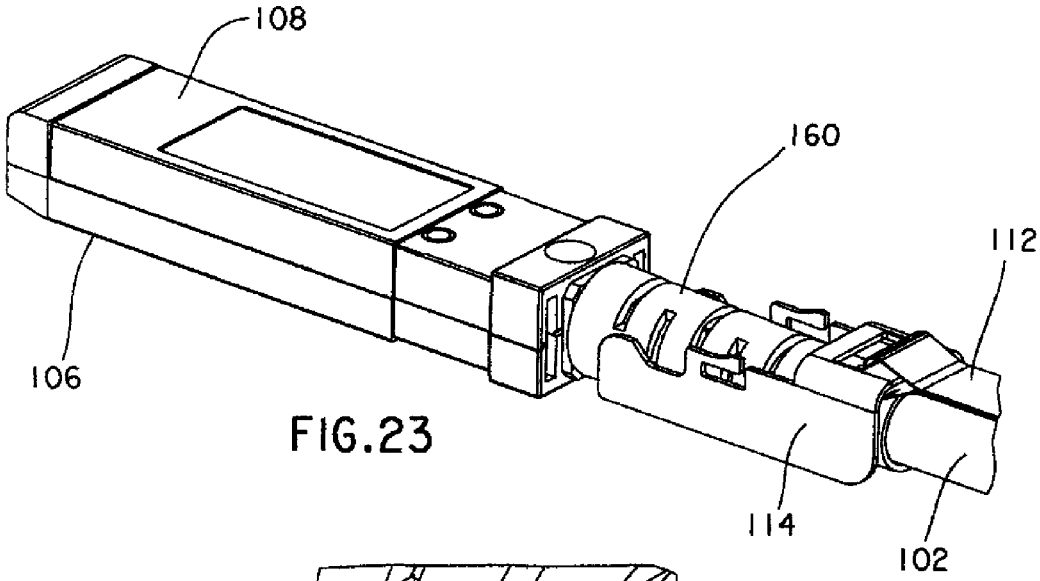
Figure 24:
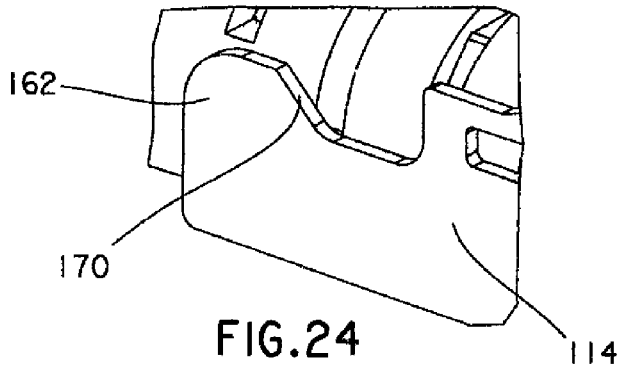
FIGS. 24-27 are perspective views showing elements of a latch release mechanism and the operation of the latch mechanism.
Figure 25:
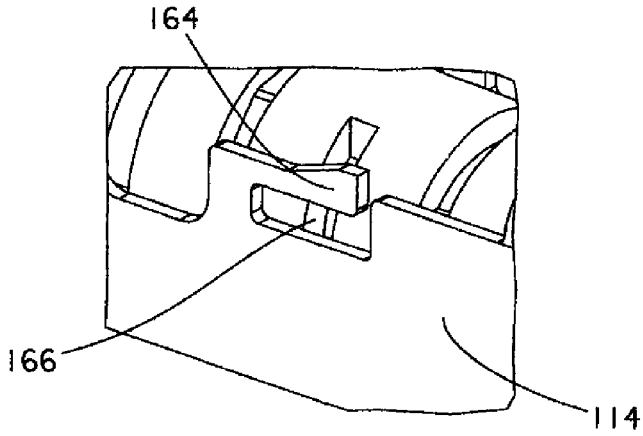

As shown in FIG. 3, a pair manager 118 preferably having at least metal walls is disposed inside the shell 104 to interface the cable 102 with a PCB (Printed Circuit Board) 120 in an organized manner that aids in reducing unwanted reflections and other potentially adverse effects. The pair-manager 118 facilitates pair-ground termination to the PCB 120, shields exposed pairs, and helps position wire pairs during assembly to the PCB 120. A crimp 124 assists in securing the cable 102 to the connector 100. A bend radius control feature 160 (see FIG. 22) may be included to assist in controlling bend radius where cable 102 enters the connector 100. This external crimp/strain-relief mechanism eases assembly and crimp operation, and allows the connector shell 104 to be shorter.

Figure 4:
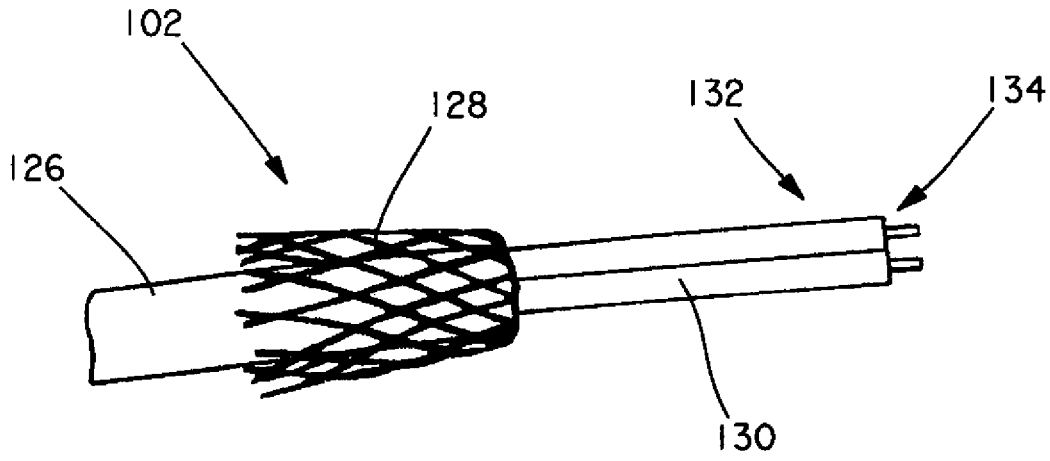
FIGS. 4 and 5 show a twin-ax cable being prepared for termination to a connector.
Figure 5:
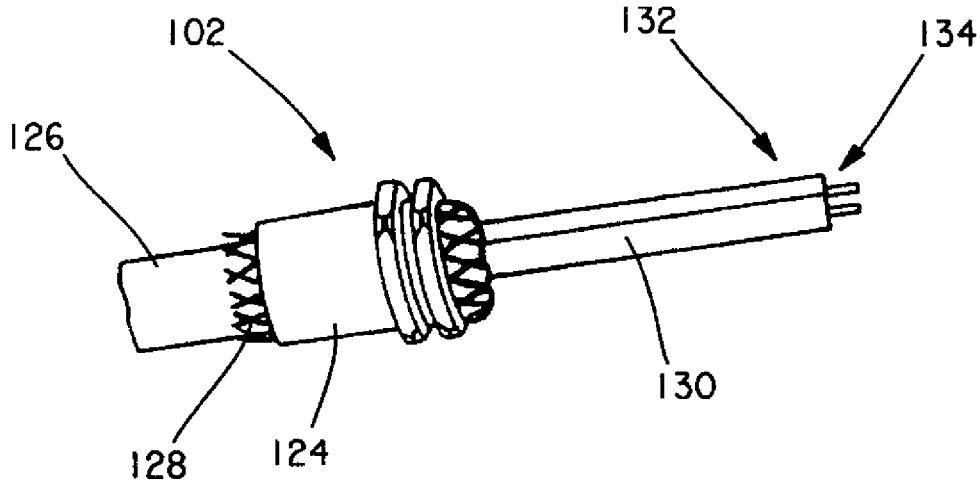

Impedance matching at the cable termination interface is accomplished by using the metal walls of the pair manager 118 as a partial cavity that is designed to match the differential impedance of twin-ax pairs with the metal shield removed or folded back (see FIGS. 4 and 5). The pair manager 118 also provides an electrical grounding system to which the drain wires of the twin-ax pairs are soldered (See FIGS. 6-14). The pair manager 118 has metal flanges (see, e.g., FIG. 6, reference numerals 136 and 148) that are designed to be soldered to the grounding pads on both surfaces of the PCB 120, providing electrical grounding as well as a mechanically robust connection to the PCB 120. Another useful design feature of the pair manager 118 is that it functions to position the twin-ax cable pairs 134 at a constant distance apart and enables at least a semi-automated termination process.

FIGS. 4 and 5 illustrate preparation of an end of the cable 102 for termination at the connector 100, for an embodiment in which a standard twin-ax metal (e.g. copper) cable is being terminated. After removing the outer jacket 126, the braid 128 is pulled back over the outer jacket 126. The foil shield 130 is removed from the insulated wire pairs 134 and then the insulation 132 is removed from a length of the end of the wire pairs 134 suitable for attachment to pads on the PCB 120. The crimp 124 is threaded onto the cable 102 and over the braid 128 near the end of the outer jacket 126.

Figure 6:
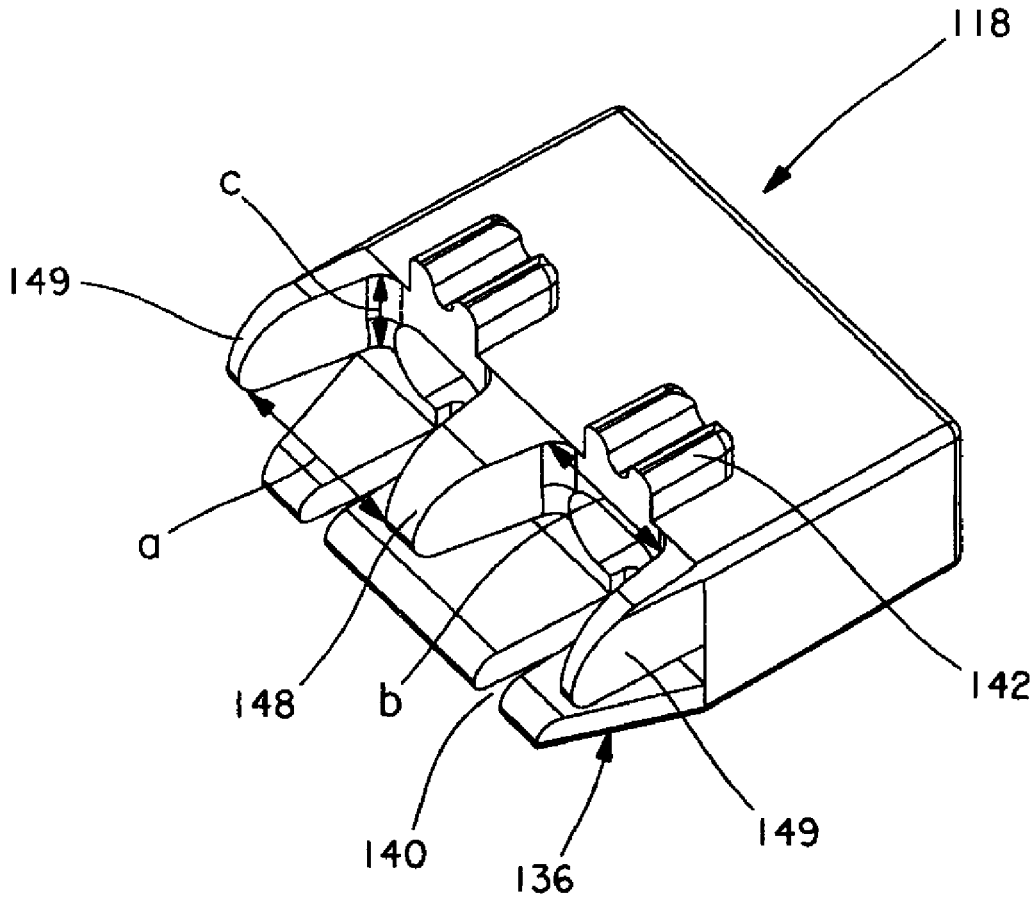
FIGS. 6-12 are perspective views of a pair manager, including views showing the provision of wires in a pair manager and the connection of the pair manager to a PCB.

FIGS. 6-14 illustrate the pair manager 118 in further detail. The pair manager has been designed to provide good impedance matching with the PCB 120. This is accomplished by sizing the depth, height, and spacing between the top flange 148 and fingers 149 such that the pair manager 118 functions as a partial shield cavity around each pair of conductors that are soldered to microstrip lines on the PCB 120. According to some embodiments, the pair manager 118 may be plated with a metal layer whose conductivity is higher than that of the base metal. In one embodiment, if the pair manager is made of zinc as a base metal, the pair manager may be plated with copper, tin, or nickel. If aluminum is used as the base metal for the pair manager, it may be plated with another metal such as silver or nickel. The dimensions of the top flange 148 and fingers 149 are parameterized as a, b, and c, as shown in FIG. 6. According to one embodiment of the present invention for use with 30-AWG twin-ax cabling, the finger-to-flange spacing, a, is about 4.4 mm; the spacing between the fingers and the flange at the base of the fingers, b, is about 3.5 mm, and the finger height, c, is about 1.3 mm.

Figure 7:
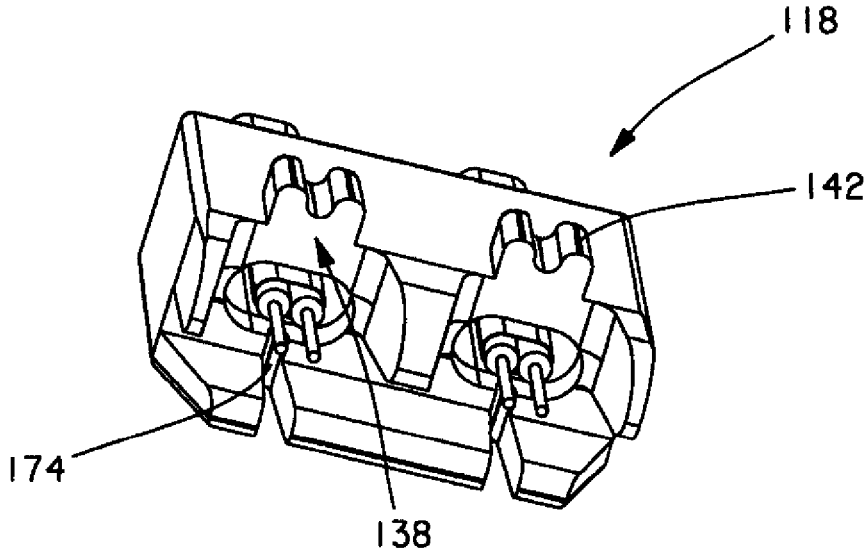
Figure 8:
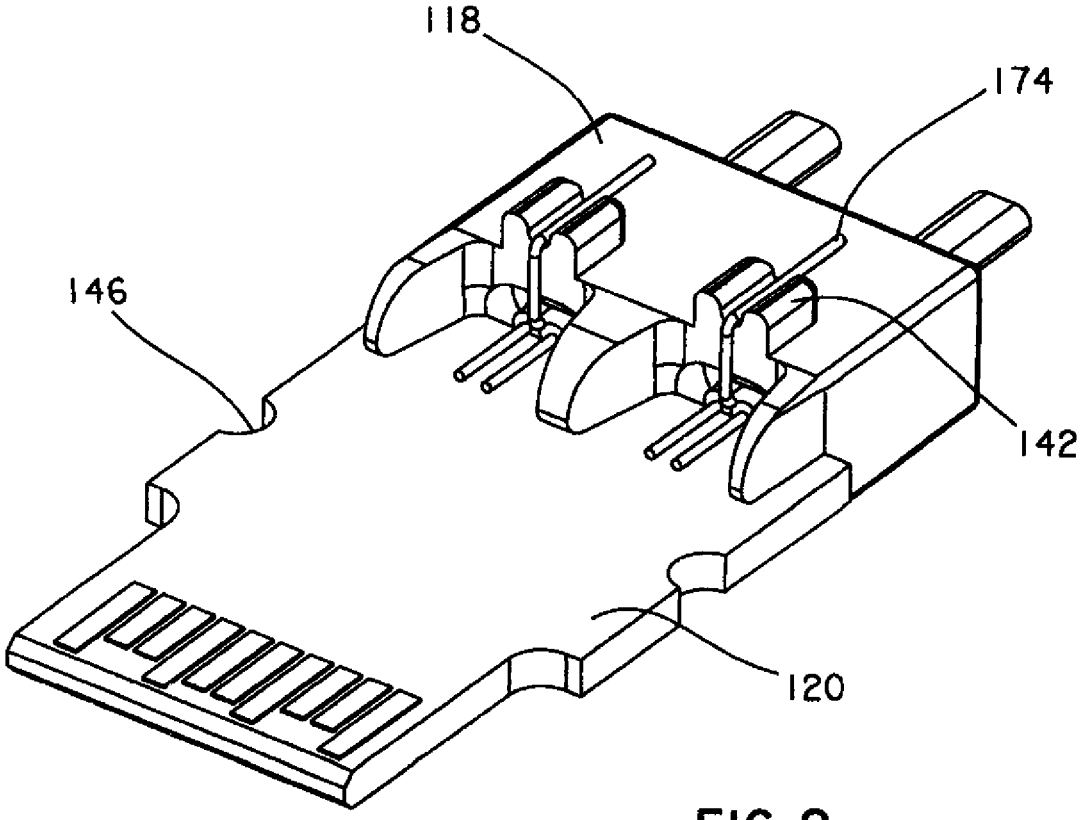
Figure 9:
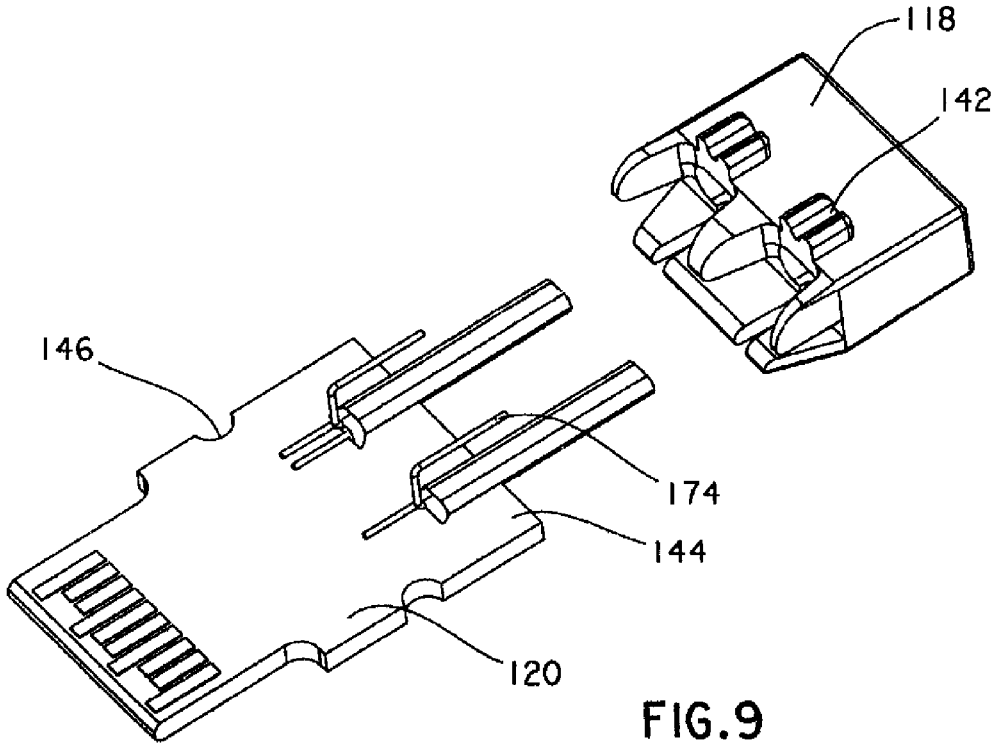
Figure 10:
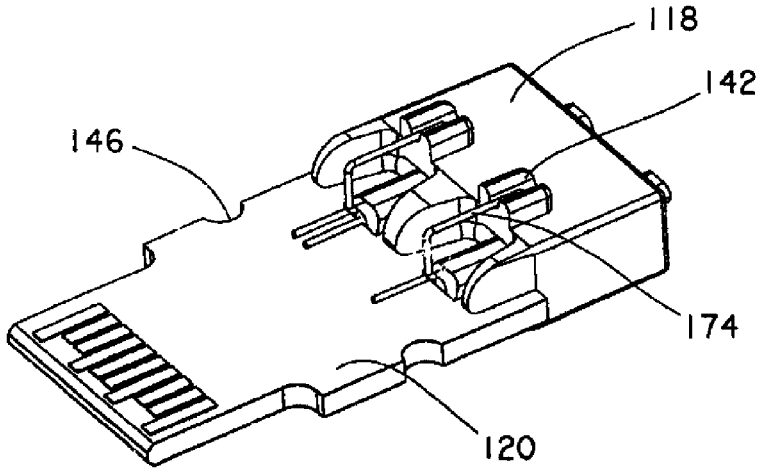
Figure 11:
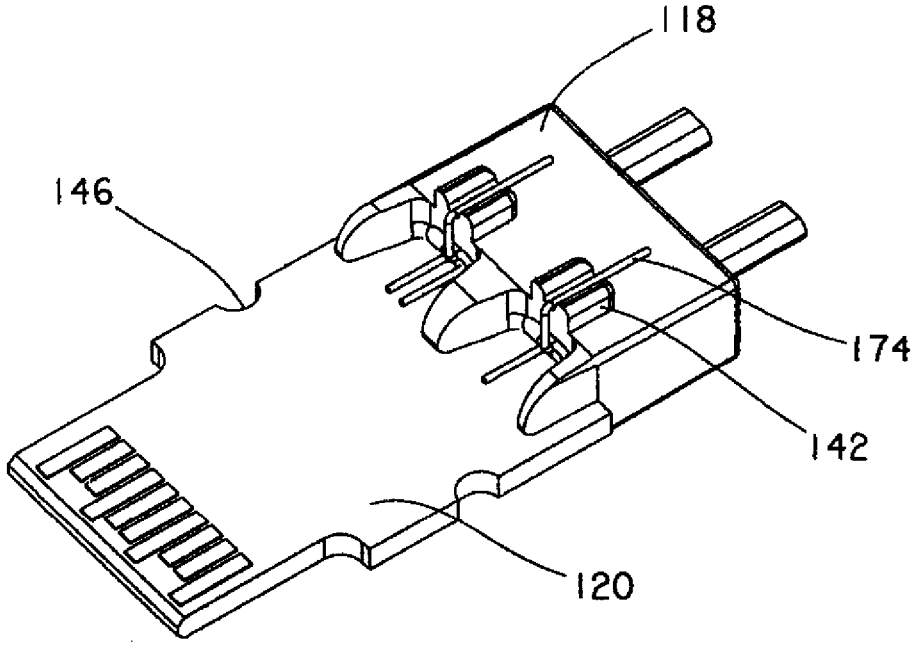
Figure 12:
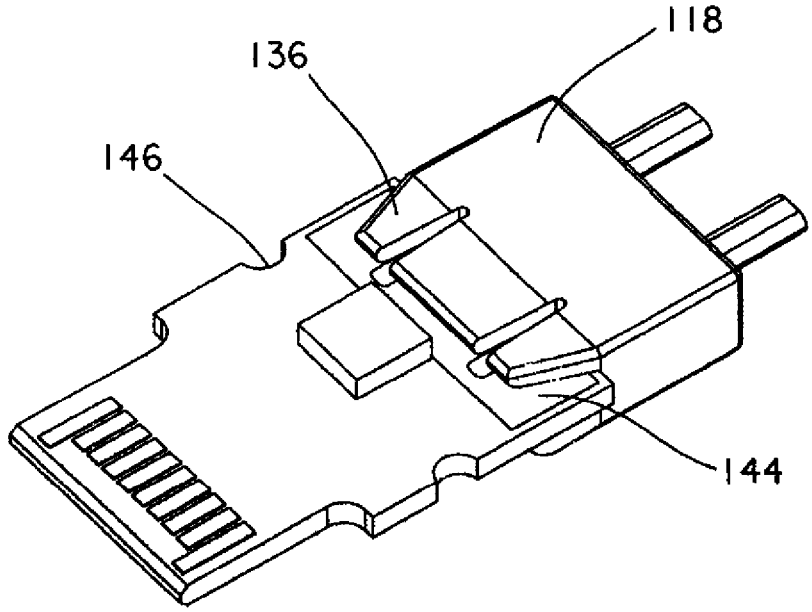
Figure 16:
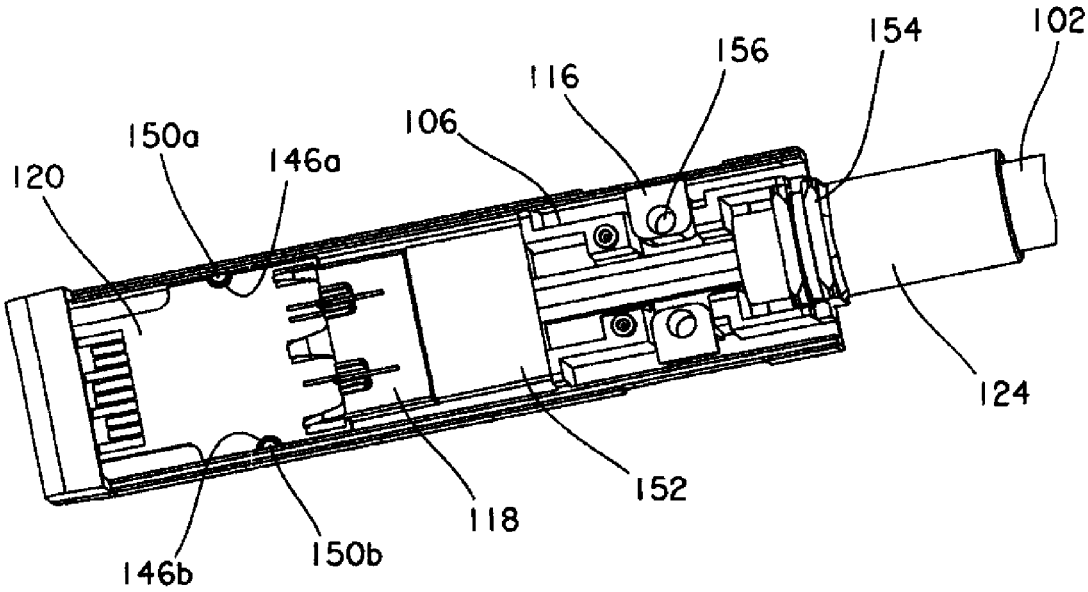
Figure 17:
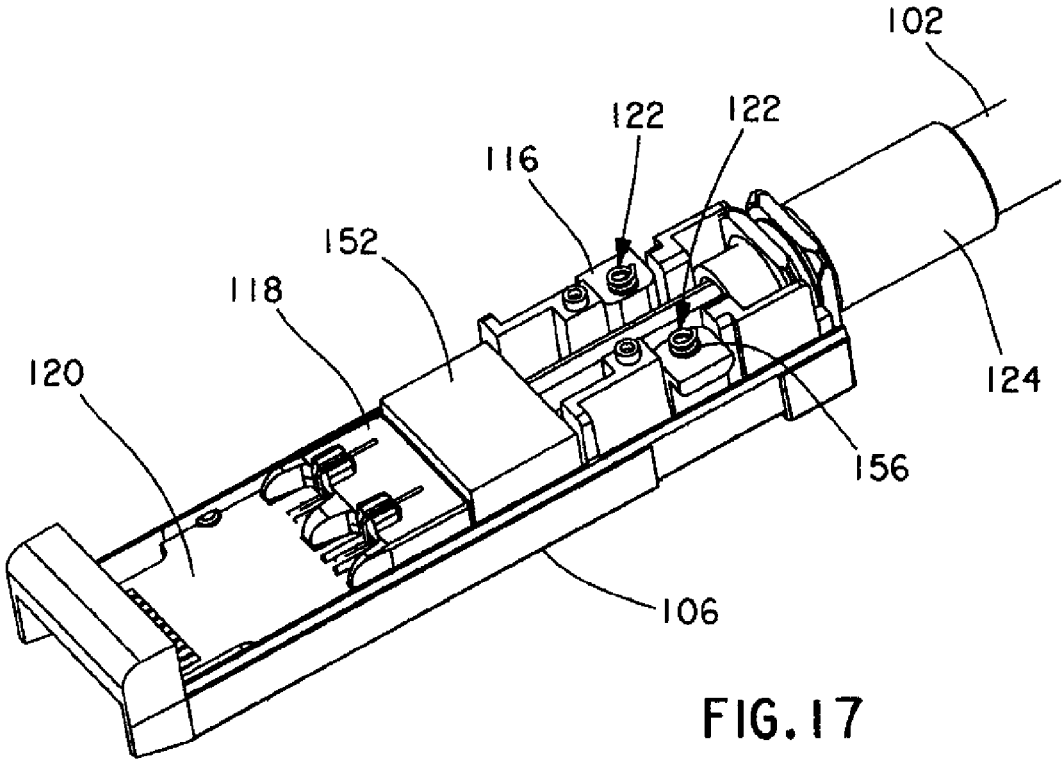
Figure 18:
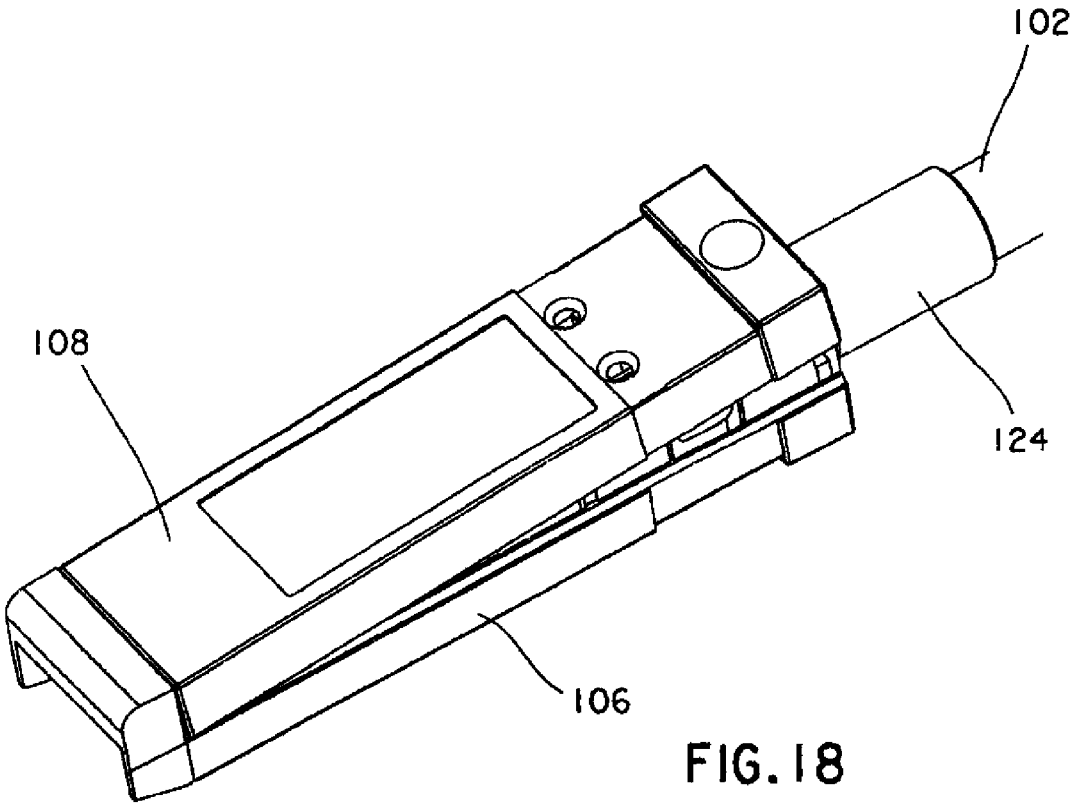
Figure 19:
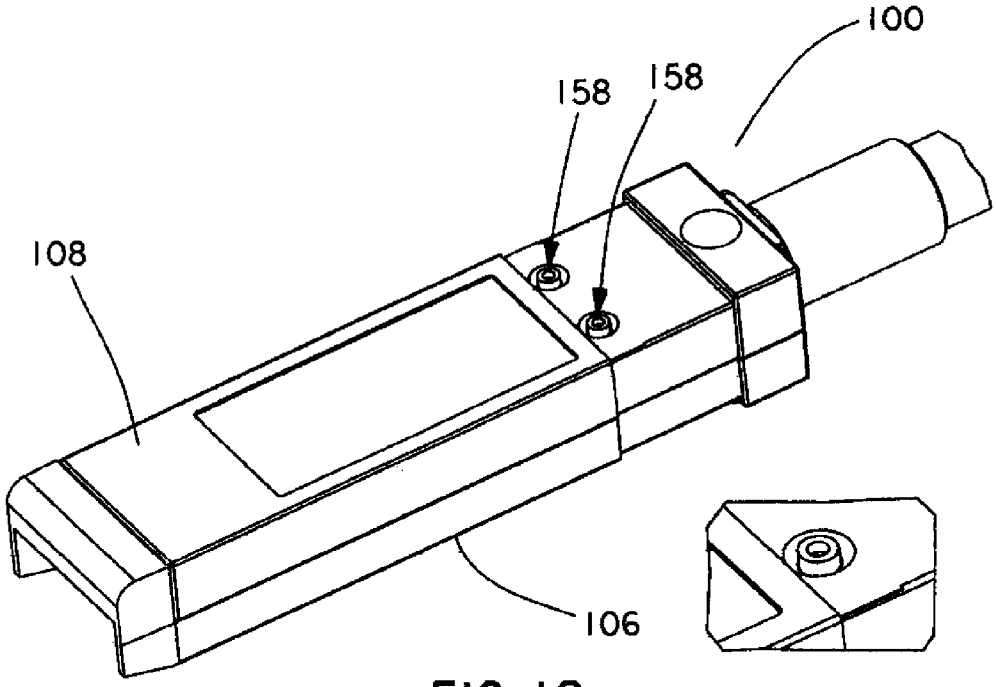
Figure 20:
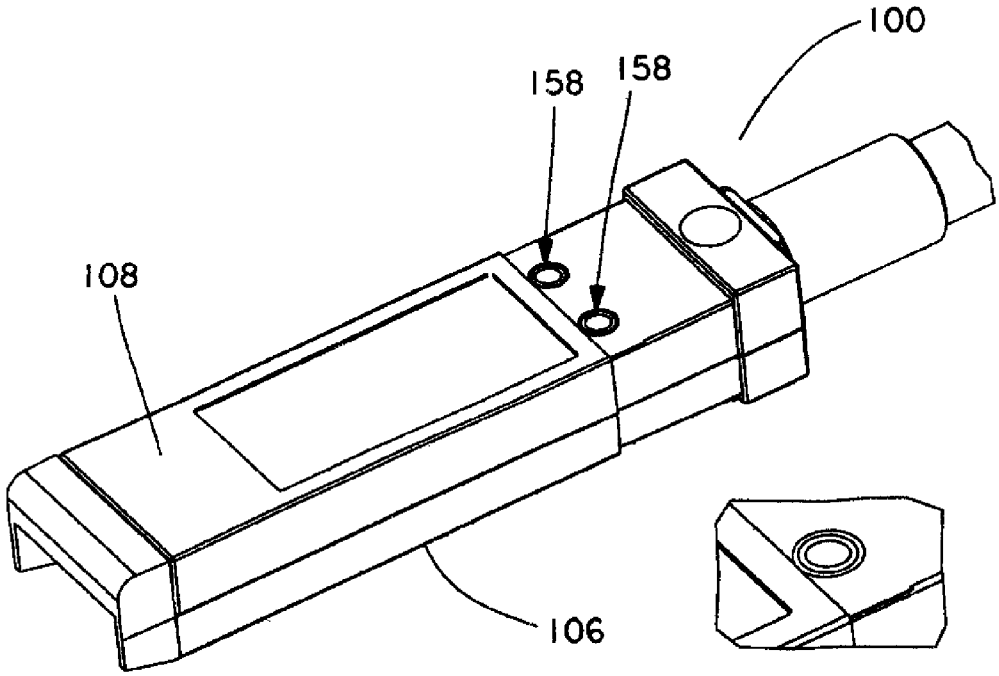
Figure 21:
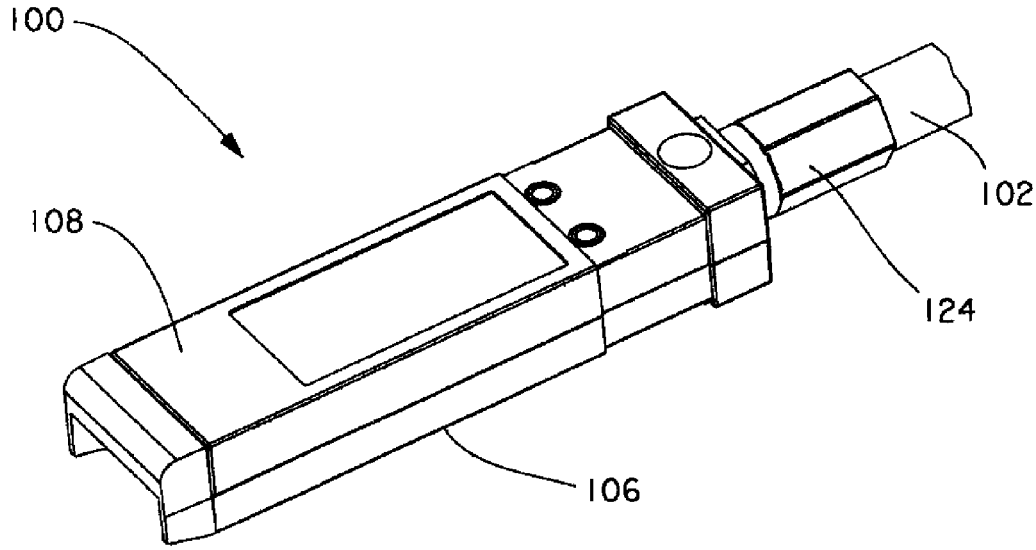

FIGS. 7-12 set forth two alternative techniques for interfacing the wire pairs 134 with the pair manager 118 and PCB 120. FIG. 7 illustrates the first technique, while FIGS. 8-12 illustrate the second technique. The PCB 120 (sometimes referred to as a "paddle card" in the industry) in each technique includes a control side and a communication side, each having associated ground pads. The pair manager 118 can be the same for each technique, but need not be. The designs for the PCB 120 and the pair manager 118 are preferably customized for each wire gauge size used for wire pairs 134. In a preferred embodiment, the pair manager 118 includes a bottom flange 136 and top flange 148 for receiving the PCB 120 between them. Ground slots 140 may be included on the bottom flange 136 to terminate ground wires 174 in accordance with the first technique. Alternatively and/or in addition, ground boss structure(s) 142 may be included on top of the pair manager 118 to terminate ground wires 174 in accordance with the second technique. The pair manager 118 is preferably constructed entirely or partially of a metal with good conductivity (such as copper, aluminum, zinc, etc.). To provide strain relief, an over-molded wire pair strain relief feature 152 (see FIG. 16) may be included. The over-molded wire pair strain relief feature 152 overlies the wire pairs 134 between the point where the foil shield 130 and insulation 132 are removed from the pairs 134 to the point where the pairs 134 enter the pair manager 118.

According to the first technique and as shown in FIG. 7, the twin-ax wire pairs 134 are positioned to have their associated ground wires 174 on the bottom (closer to the bottom flange 136) of the pair manager 118. The wire pairs 134 are threaded through holes (preferably two separate holes) in the pair manager 118 until the insulation 132 on each wire pair 134 is flush with the front face 138 of the pair manager 118. The ground wires 174 are then pulled through the ground slot 140 on the bottom flange 136. The pair manager 118 is pressed onto the PCB 120. The ground wires 174 are then soldered (or otherwise electrically connected) to a PCB ground pad 144 on the underside of the PCB 120 (see, e.g., FIGS. 12 and 13).

According to the second technique and as shown in FIGS. 8-12, the pair manager 118 is first assembled to the PCB 120, such as by using reflow, crimp, or resistance welding. The twin-ax wire pairs 134 are positioned to have their associated ground wires 174 on the top (closer to the top flange 148) of the pair manager 118. The wire pairs 134 are threaded through the pair manager 118 until the insulation 132 on each wire pair 134 is flush with the front face 138 of the pair manager 118. The ground wires 174 are then positioned on the ground boss(es) 142 on the top of the pair manager 118. Each ground boss 142 preferably includes a slot (as shown) or hole through which the ground wires 174 may pass. The ground wires 174 are then connected to the pair manager 118, such as by soldering or crimping. The location on the pair manager 118 at which the ground wires 174 are connected provides one or more electrical connections to the PCB ground pad 144 on the communication side of the PCB 120.

Figure 13:
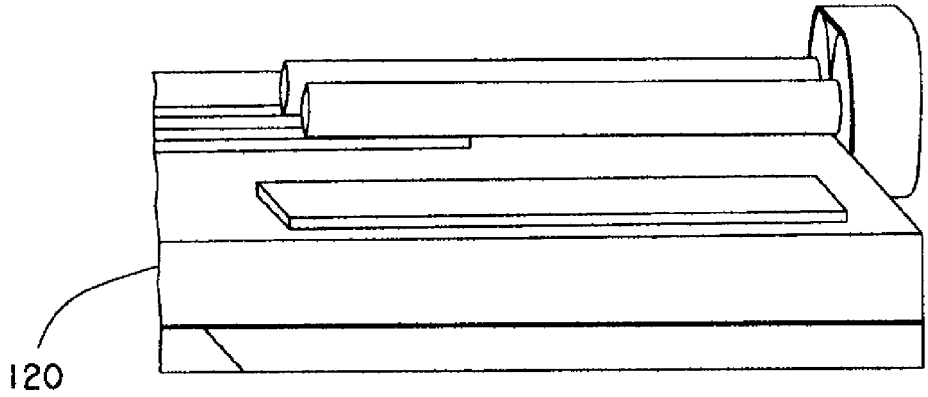
FIGS. 13 and 14 show wires of a twin-ax cable terminated to a PCB.
Figure 14:
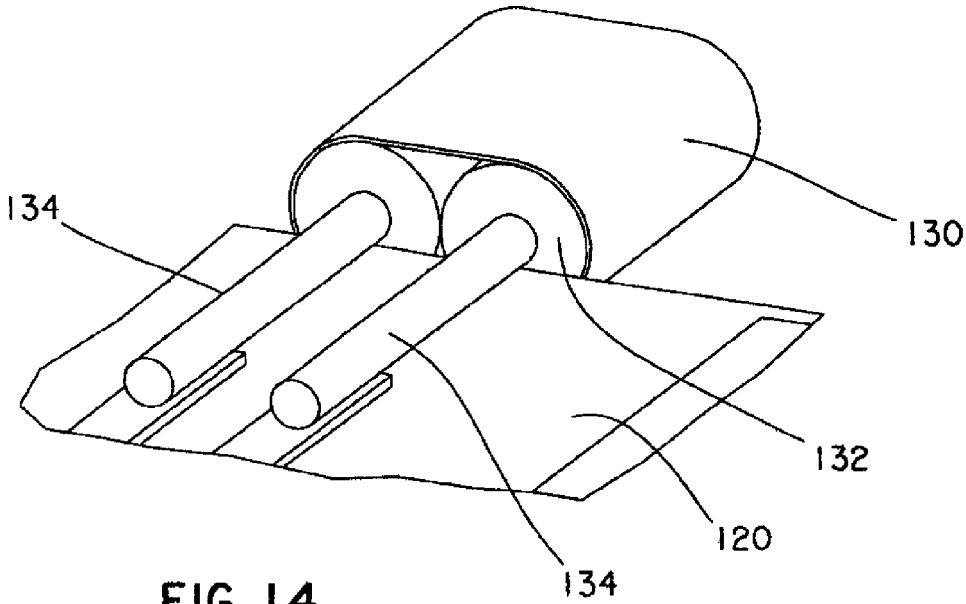
Figure 15:
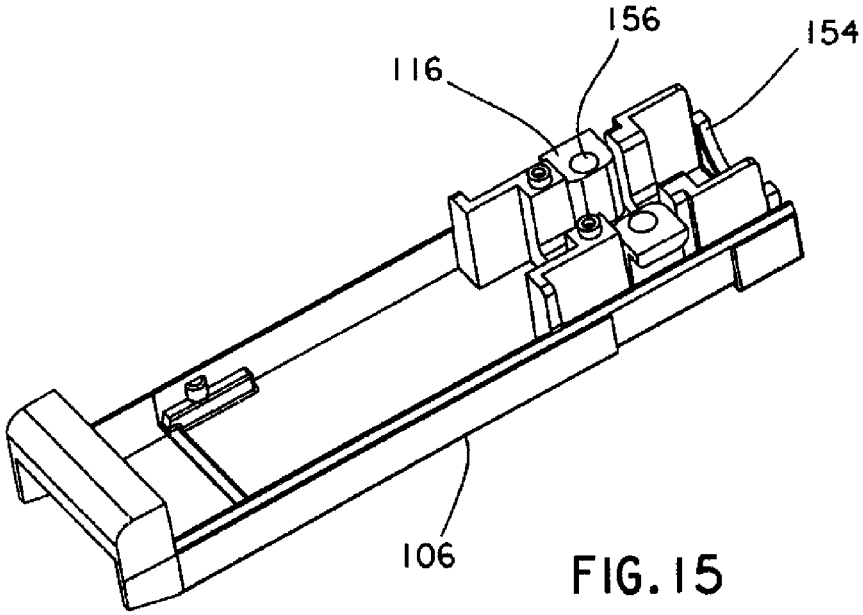
FIGS. 15-23 are perspective views showing the termination of a twin-ax cable to a pluggable cable connector and further assembly of the connector.

To provide electrical connectivity between the twin-ax wire pairs 134 and the PCB 120, the wire pairs 134 are soldered to signal pairs on the PCB 120, as shown in FIGS. 13 and 14. The signal pairs on the PCB 120 may be used to provide tuned impedance matching (e.g. by introducing distributed or lumped capacitance and/or inductance through conductive traces or discrete components on the PCB 120) and provide an electrical connection to the host receptacle, which may be part of a network switch, for example.

The high-speed signals are sent from the host system through the connector onto the PCB where they propagate along micro strip transmission lines to the PCB/twin-ax interface. The micro strip lines are designed to ensure the proper characteristic impedance by maintaining inductance and capacitance characteristics along the length of the transmission line. Controlling the conductor widths, spacing, height above a ground plane, and dielectric material between the traces and the ground plane accomplish this. Impedance-matching techniques are generally known and will likely be specific to the particular application, wire gauge, and configuration for which the connector 100 is used.

Next, if desired, the assembly can be tested to ensure that electrical performance requirements are met. Then, in accordance with a preferred embodiment, the various components of the connector 100 are assembled, as shown generally in FIGS. 15-25. First, the latch 116 is inserted into an opening in the bottom shell 106. The assembly comprising the PCB 120, the pair manager 118, the cable 102, and the crimp 124 is placed over support rails in the bottom shell 106. To prevent upside-down assembly, locating pins 150*a-b* offset from one-another are aligned with correspondingly offset PCB slots 146*a-b* on the PCB 120. The crimp 124 is placed over a bottom shell opening 154 and pressed into position. The springs 122 are loaded into latch spring pockets 156 located on the upper surface (away from the bottom shell 106) of the latch 116. The front end of the top shell 108 is inserted under the front end of the bottom shell 106. The top shell 108 is then rotated down over the bottom shell 106 so that sidewalls of the top shell 108 and bottom shell 106 align and the top shell 108 aligns over bottom shell bosses 158 located in the bottom shell 108. The bottom shell bosses 158 may be flared out to permanently assemble the bottom shell 106 and top 108 to become shell 104. Other techniques (such as ultrasonic welding, fastening, etc.) may be used to complete the assembly of shell 104.

The cable 102 is then crimped using crimp 124 and the bend radius control feature 160 is molded over the crimp 124 and the cable 102. The latch release 114 (with attached pull tab 112) is inserted into slots on the back face of the shell 104. Finally, as shown in FIGS. 28 and 29, the EMI gasket 110 may be attached to the shell 104 using adhesive or snaps, for example.

FIGS. 23-27 illustrate the latch release 114 and its operation in further detail. Each side of the latch release 114 preferably includes a latch cam 162 and a latch release snap 164. The latch cam 162 includes a latch cam face 170 (see FIG. 24) and the latch release snap 164 includes a snap deflection slot 166 (see FIG. 25).

The latch release snap 164 deflects downward (toward its snap deflection slot 166) as the latch release 114 is being inserted into the shell 104 and retracts back upward into a top shell pocket 168. This limits subsequent travel of the latch release 114 and prevents the latch release 114 from pulling out. A top portion of the latch release snap 164 preferably contacts the upper surface (i.e. stop face) of the top shell pocket 168.

Figure 26:
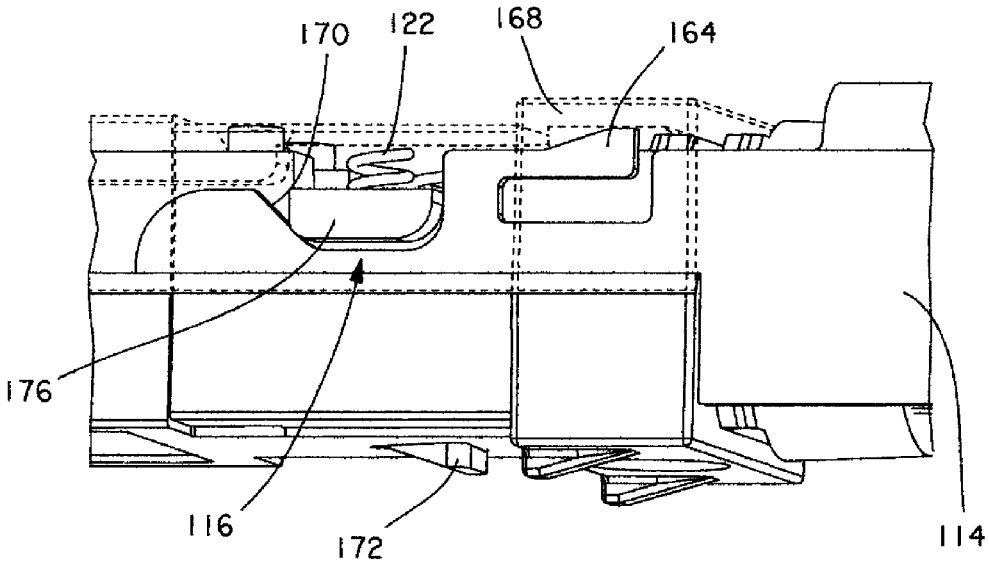
Figure 27:
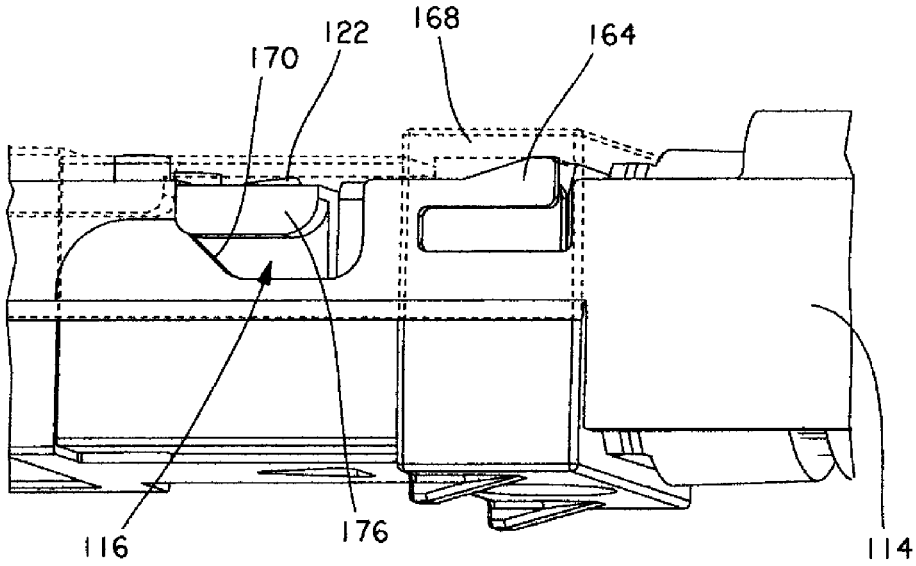

When the pull tab 112 is pulled, the latch cam face 170 on the latch release 114 applies an upward force to the latch cam feature 176 on the latch 116 (i.e. the latch cam feature 176 rides up the ramped latch cam face 170 to cause the latch 116 to move upward (toward the top shell 108), thereby compressing the springs 122. This, in turn, causes the latch tooth 172 to recede into the bottom shell 106, which allows the connector 100 to be removed from the host receptacle. This transition is shown in FIG. 26 (latch release position before pull) and FIG. 27 (latch release position after pull). The resulting spring-loaded latch is (a) preferably housed entirely inside the connector cavity and (b) retracted in for de-latching. De-latching is done by a latch-release pull motion translated into an inward pull on the latch.

Pair managers according to some embodiments of the present invention maintain the differential impedance of twin-ax conductive pairs with the foil shields surrounding the twin-ax pairs removed or folded back. Preferably, transmission line impedance is maintained along a great extent of the signal pathway. Because the pair manager provides an efficient capacitive coupling between signal ground and the shield of the twin-ax cable, the common-mode return path is well balanced, thus assuring signal fidelity. According to some embodiments, grounding provided by a pair manager is isolated from the chassis ground path of the connector shells in the DC domain.

Connectors 100 and corresponding pair managers 118 can be designed for different gauges of twin-ax cable.

Ground pads 144 on PCB 120 may be soldered to tabs (fingers 149) of the pair manager.

The choice of soft metals such as zinc or aluminum for the pair manager makes the tabs (fingers 149) of the pair manager easier to crimp, eliminating the need for an overmolded strain relief in the region of termination of the twin-ax pairs to a PCB 120 and eliminating a process step in the manufacture of an SFP+ cable assembly. Because overmolding is not necessary in the region of termination, the likelihood of delamination of the PCB 120 due to mismatches in thermal expansion coefficients is minimal when compared to prior art connectors. In addition, there is a low likelihood of moisture absorption in the region of termination for the operating life of the cable assembly.

In various embodiments, the pair manager 118 may be only crimped to the PCB 120, crimped and then soldered to the PCB 120, or only soldered to the PCB 120.

The following is a summary of the connections between a twin-ax cable and elements of an SFP connector according to one embodiment of the present invention:

- The outer shield 128 of the twin-ax cable is connected to the shell 104 of the SFP+ connector via the crimp 124.
- The foil pair shields 132 of the twin-ax conductive pairs and the drain wire 174 are connected to the pair manager 118 by soldering and/or crimping.
- The pair manager 118 in turn is connected to the signal ground of the PCB 120 via ground pads 144 on the top and bottom of the PCB 120 by soldering and/or crimping.
- Internal ground planes 80 of the PCB 120 are connected to the signal ground I/O of the connector through vias 64 as shown in FIGS. 28A-29B.
- In addition, the conductive signal pairs of the twin-ax cable are terminated via soldering to trances on the PCB 120.

In addition to the conductive connections described above, all of the shields, including the drain wire, and the ground planes of the paddle card are coupled to each other by capacitive reactance in the AC domain.

The signal ground is isolated in the DC domain from the chassis ground (provided by the outer shield 128, shell 104, and crimp 124) of the connector. Signal ground is provided by the PCB and pair manager assembly which, after mating with an SFP host port, connect to the signal ground of a backplane PCB in a switch or host server. This DC isolation is important for the function of differential signaling, because in some embodiments, without this DC isolation, the host port cannot discern the logic states of the signals, resulting in communication failure.

Pair managers 118 according to some embodiments of the present invention may be provided in more than one piece.

Figure 28A:
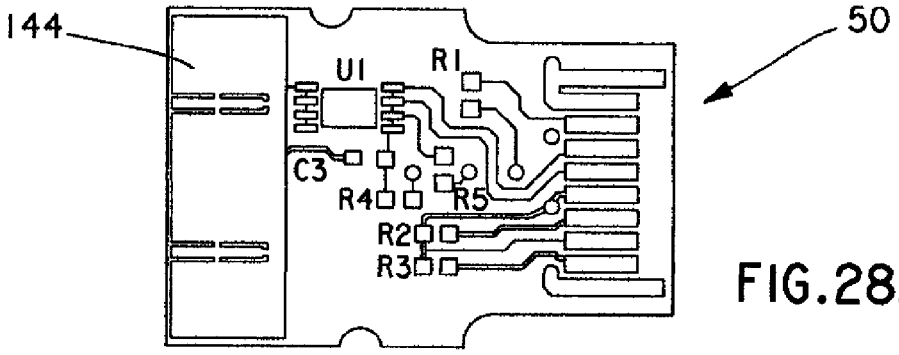
FIGS. 28A-29B are plan views of conductive traces of layers of a PCB.
Figure 28B:
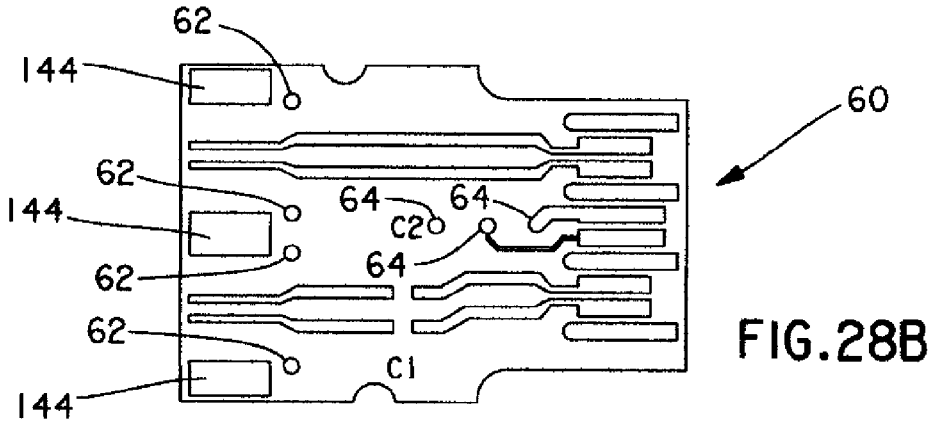

According to one embodiment of the present invention, the PCB 120 is provided with four conductive layers. The layers of the PCB 120 are illustrated in FIGS. 28A, 28B, 29A, and 29B. FIGS. 28A and 28B illustrate, respectively, the internal bottom side (control side) layer 50 and top (communication side) conductive layers 60 of the PCB 120. The ground pad(s) 144 of the bottom layer 50 are visible in FIG. 28A and the ground pads 18 of the top layer 60 are shown in FIG. 28B.

Figure 29A:
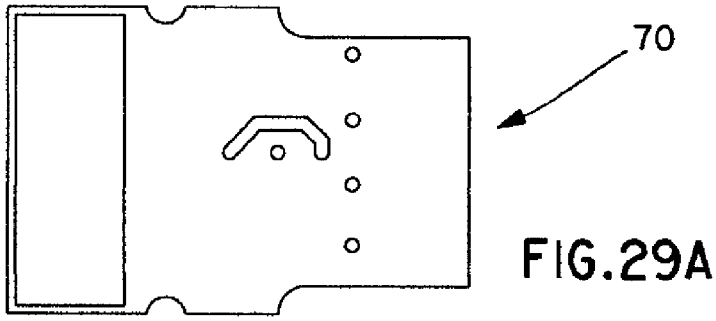
Figure 29B:
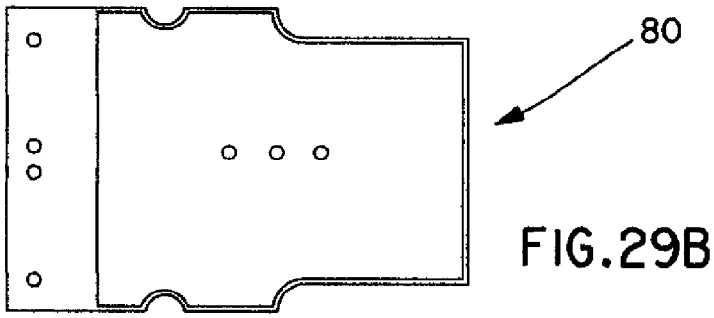

FIGS. 29A and 29B illustrate, respectively, the internal ground plane 70 above the bottom layer 50 and the internal ground plane 80 below the top layer 60. Resistors and capacitors are labeled, respectively, as R and C, and U1 indicates a microcontroller. The ground pad 144 shown in FIG. 28A connects through vias (not visible) to the internal ground plane 70 shown in FIG. 9A. The ground pads 144 shown in FIG. 28B also connect to the internal ground plane 70 shown in FIG. 29A.

The vias 62 shown in FIG. 28B connect to the ground plane 80 of FIG. 29B, which in turn connects (by three vias) to the signal ground I/O through vias 64.

Figure 30:
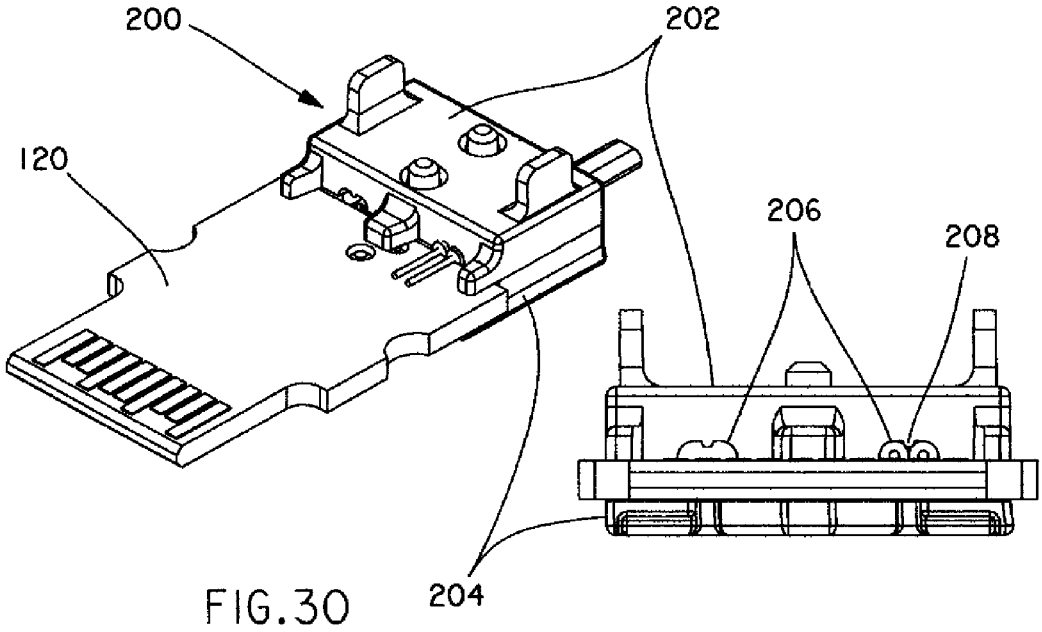
FIGS. 30 and 31 are perspective and exploded views of an alternative embodiment of a pair manager.
Figure 31:
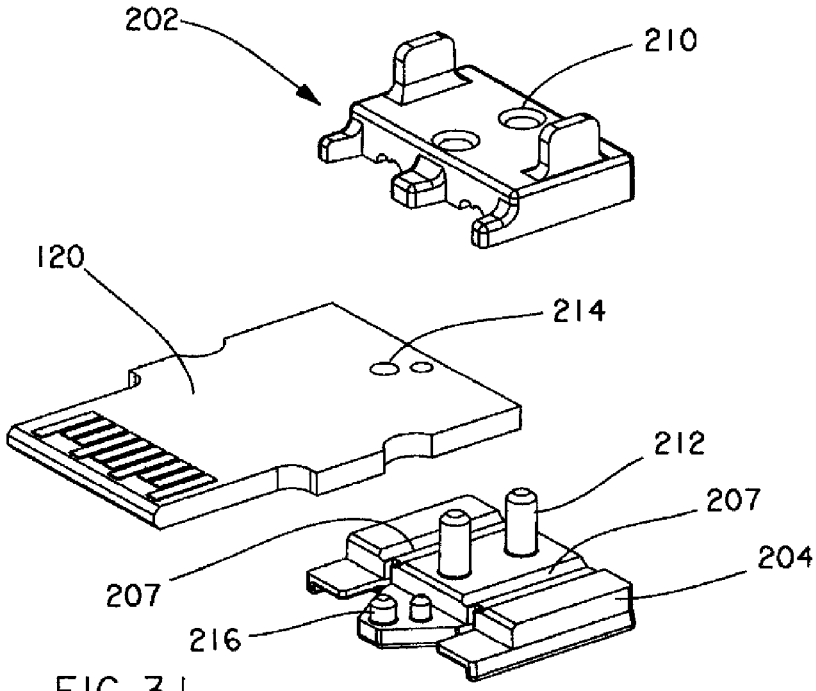

FIGS. 30 and 31 show an alternative embodiment of a pair manager 200 that comprises top and bottom halves 202 and 204. The top half of the split pair manager 200 has top aperture halves 206 incorporating a rib 208 that serves to keep a twin-ax pair in place more firmly within the holes formed when the top and bottom halves 202 and 204 are assembled together and the top aperture halves 206 sit over the lower aperture halves 207 as shown in FIG. 31. As shown in FIG. 31, the top half 202 is provided with rivet holes 210 that accept rivets 212 provided in the bottom half 204.

In situations where multiple gauges of wires are being terminated to PCBs 120, different pair managers are used. When these pair managers are provided in halves, the rivets 212 and rivet holes 210 may be appropriately sized and/or spaced to provide a keying feature so that proper halves are mated. An additional keying hole 214 can be provided on PCBs 120 to mate with a keying feature 216 provided on the bottom half 204, helping to make sure that the proper PCB is mated with the proper pair manager for a particular wire gauge being used.

While particular embodiments and applications of the present invention have been illustrated and described, it is to be understood that the invention is not limited to the precise construction and compositions disclosed herein, and that various modifications, changes, and variations may be apparent from the foregoing descriptions without departing from the spirit and scope of the invention.

The invention claimed is:

1. A pair manager for securing cables to a printed circuit board comprising:

a top portion, the top portion having a pair of apertures formed on a bottom side of the top portion, the apertures extending from a front face of the top portion to a rear face of the top portion, the top portion also having a tab extending from the front face of the top portion in between the pair of apertures and a pair of fingers also extending from a front face of the top portion on opposite sides of the pair of apertures; and a bottom portion, the bottom portion having a pair of apertures formed in a top side of the bottom portion wherein the apertures of the top portion and the apertures of the bottom portion are configured to align and form channels when the top portion is mated to the bottom portion;

wherein the fingers and tab on the top portion are arranged such that a partial shield cavity is formed forward a front face of a mated top portion and bottom portion forward where the apertures exit the front face of the mated top portion and bottom portion.

2. The pair manager of claim 1 wherein the top flange and fingers generally decrease in height with increasing distance from the front face of the top portion.

3. The pair manager of claim 1 wherein the top flange and fingers generally decrease with thickness with increasing distance from the front face of the top portion.

4. The pair manager of claim 1 wherein the apertures of the top portion incorporate a rib.

5. The pair manger of claim 1 wherein the top portion has rivet holes configured to accept rivets provided in the bottom portion.

* * * * *

UNITED STATES PATENT AND TRADEMARK OFFICE

CERTIFICATE OF CORRECTION

PATENT NO. : 8,172,602 B2
APPLICATION NO. : 13/283692
DATED : May 8, 2012
INVENTOR(S) : Satish I. Patel et al.

It is certified that error appears in the above-identified patent and that said Letters Patent is hereby corrected as shown below:

Column 8, line 23, which reads "The pair manger of claim 1 wherein the top portion has" should read "The pair manager of claim 1 wherein the top portion has".

Signed and Sealed this
Second Day of April, 2013

Teresa Stanek Rea
*Acting Director of the United States Patent and Trademark Office*